US005754918A

United States Patent [19]

Mestha et al.

[11] Patent Number: 5,754,918

[45] Date of Patent: May 19, 1998

[54] ELECTROSTATIC CONTROL WITH COMPENSATION FOR COUPLING EFFECTS

[75] Inventors: Lingappa K. Mestha, Fairport, N.Y.; Prasad Padmanabhan, San Francisco, Calif.

[73] Assignee: Xerox Corporation, Stamford, Conn.

[21] Appl. No.: 759,196

[22] Filed: Dec. 4, 1996

[51] Int. Cl.[6] ..... G03G 21/00

[52] U.S. Cl. ..... 399/48; 399/50; 399/51

[58] Field of Search ..... 399/38, 48, 50, 399/51, 73

[56] References Cited

U.S. PATENT DOCUMENTS 5,243,383 9/1993 Parisi ..... 355/208

*Primary Examiner*—Nestor R. Ramirez
*Attorney, Agent, or Firm*—Ronald F. Chapuran

[57] ABSTRACT

An electrostatographic printing machine having an imaging member with a surface voltage potential and a control system including first and second reference values. A sensor measures first and second surface voltage potentials that are compared to the first and second reference values to provide first and second error signals to control first and second process stations in the printing machine. A first compensator responds to the first error signal to provide a first weighted adjustment to the first process station and a second weighted adjustment to the second process station. A second compensator responds to the second error signal to provide a first weighted adjustment to the second process station and a second weighted adjustment to the first process station in order to compensate for coupling effects between adjustments to either the first or second processing stations.

18 Claims, 5 Drawing Sheets

ELECTROSTATIC CONTROL WITH COMPENSATION FOR COUPLING EFFECTS

This invention relates generally to an electrostatographic printing machine and, more particularly, concerns a process to compensate for coupling effects within a control system.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

As described, the surface of the photoconductive member must be charged by a suitable device prior to exposing the photoconductive member to a light image. This operation is typically performed by a corona charging device.

One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

Various systems have been designed and implemented for controlling charging processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface. U.S. Pat. No. 5,243,383 discloses a charge control system that uses three parameters to determine a substrate charging voltage, a development station bias voltage, and a laser power for discharging the substrate. The parameters are various difference and ratio voltages.

A difficulty with the prior art is the relative inability to compensate for the effects of an adjustment to one portion of the xerographic process on other portions of the xerographic process. For example, electrostatic controls for xerographic print engines require the accurate adjustment of scorotron or dicorotron grid voltages and the Raster Output Scanner (ROS) power. The grid voltage is varied to achieve the required uniform charge on the bare photoreceptor. The exposure level is controlled by varying the laser power. An ESV sensor is used to measure the amount of charge on the photoreceptor before and after the exposure. After the measurement is done, error signals are generated by comparing the ESV sensor readings to the predetermined charge and exposure levels.

Then the error signals are independently integrated to generate the grid voltage and the laser power. In this way, the electrostatic feedback system currently used in printers is built to operate with two independent feedback loops. These independent loops do not consider the coupling terms in the electrostatic system. The coupling terms are, for example, due to the effects on exposure level when the grid voltage is changed. In some photoreceptors, laser power also affects the voltage on the bare photoreceptor when the print cycle repeats. When controls are exerted by independent loops it would not be possible to overcome the undesirable effects due to internal coupling in the electrostatic system.

It would be desirable, therefore, to be able to provide an adjustment to a system parameter within one control loop and at the same time be able to compensate for effects of the adjustment to parameters controlled by other control loops. It is an object of the present invention, therefore, to provide a xerographic control system that automatically compensates for the effects on given control parameters after an adjustment to a first control parameter. It is another object of the present invention to respond to adjustments to system parameters within a first control loop to automatically compensate for the effects of the adjustments on parameters controlled by other control loops. Other advantages of the present invention will become apparent as the following description proceeds, and the features characterizing the invention will be pointed out with particularity in the claims annexed to and forming a part of this specification.

SUMMARY OF THE INVENTION

The present invention relates to an electrostatographic printing machine having an imaging member with a surface voltage potential and a control system including first and second reference values. A sensor measures first and second surface voltage potentials that are compared to the first and second reference values to provide first and second error signals to control first and second process stations in the printing machine. A first compensator responds to the first error signal to provide a first weighted adjustment to the first process station and a second weighted adjustment to the second process station. A second compensator responds to the second error signal to provide a first weighted adjustment to the first process station and a second weighted adjustment to the second process station in order to compensate for coupling effects between adjustments to either the first or second processing stations.

Other features of the present invention will become apparent as the following description proceeds and upon reference to the drawings, in which.

Figure 1:
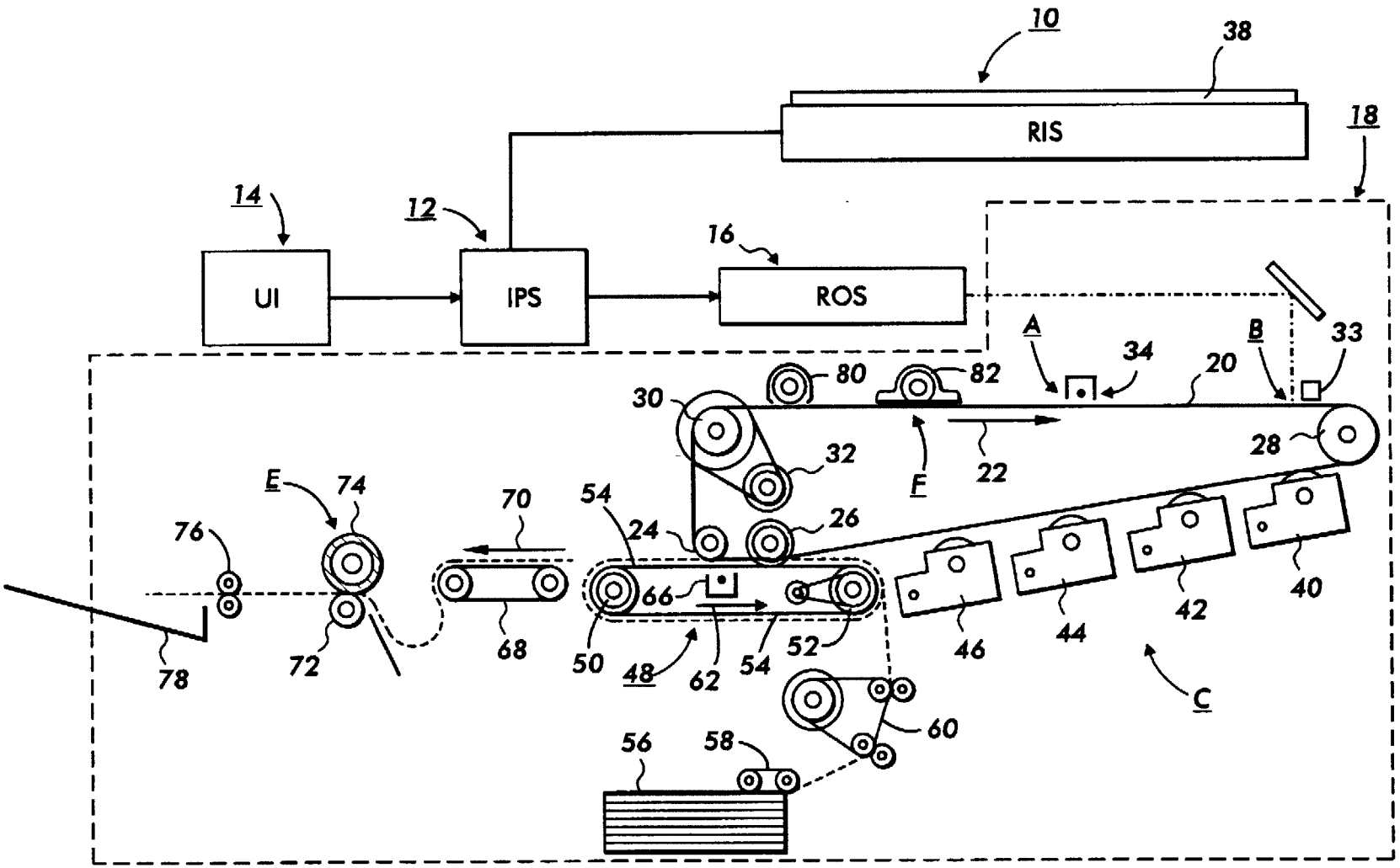
FIG. 1 is a schematic elevational view of an exemplary multi-color electrophotographic printing machine which can be utilized in the practice of the present invention.

A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned there at. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

Figure 2:
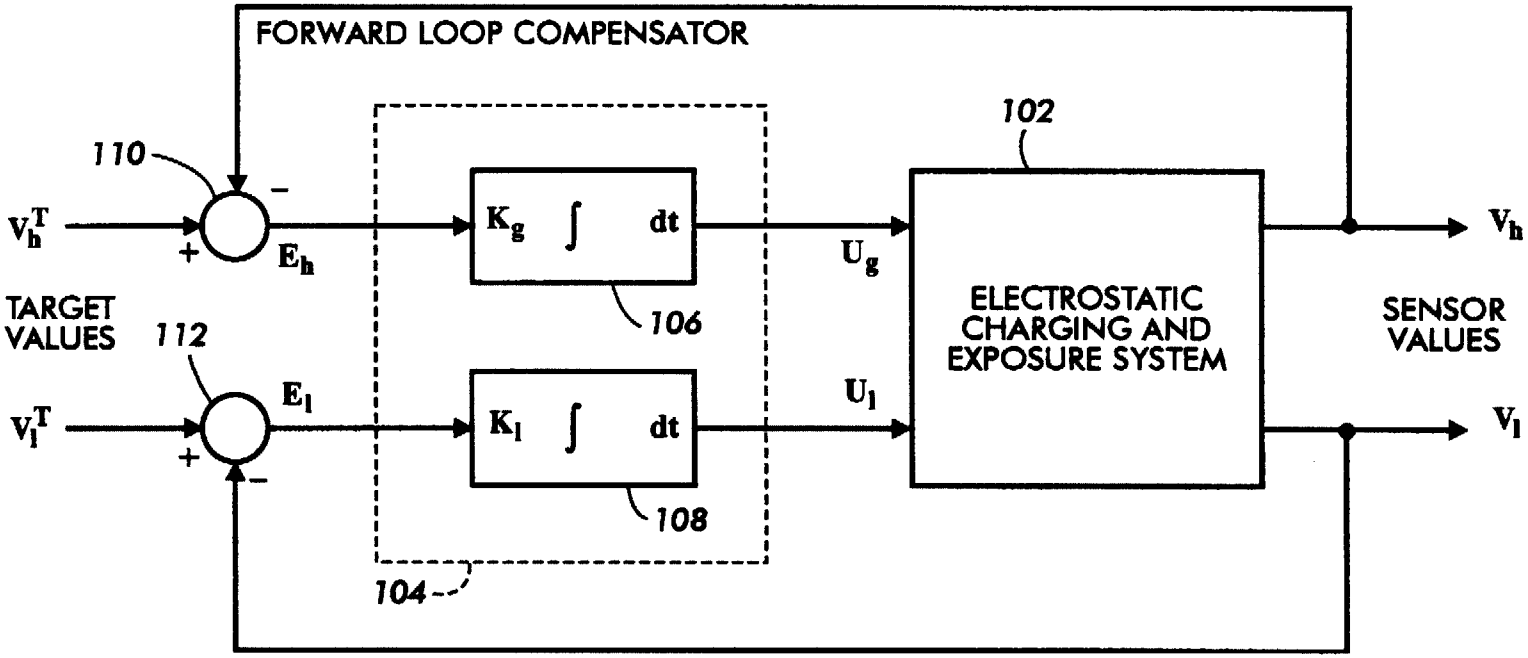
FIG. 2 is a diagram of a typical prior art electrostatic feedback control system.

A diagrammatic representation of the system currently under practice for most xerographic printer engines is shown in FIG. 2. Block 102 represents the charging and exposure systems. The block 104 representing compensators usually contains integrators such as 106, 108 with some weighting. Here $V_h$ represents the voltage on the unexposed photoreceptor, and $V_l$ represents the voltage on the photoreceptor after the exposure. $V_h^T$ and $V_l^T$ are the desired states for the voltages $V_h$ and $V_l$. $E_h$ is the error signal generated at summing node 110 by subtracting the $V_h^t$ values from the voltage measured by the ESV before exposure. Similarly, $E_l$ is the error signal generated at summing node 112 by subtracting the $V_l^T$ values from those measured by the ESV after the exposure. $U_g$ and $U_l$ are the control signals used to vary the grid voltage and laser power respectively.

When target values change, large errors are created in the system. In a stable feedback system $V_h$ and $V_l$ settle to new target values within a few prints depending on the integrator weights. The type of control system shown in this figure is called a single input single output (SISO) system. As mentioned, when $U_g$ varies, the charging system changes both $V_h$ and $V_l$. That means $U_g$ and $V_l$ are coupled. To understand the inability for this control system to correct for coupling effects, let us consider a case where $V_h$ and $V_l$ have reached the preset target values. If for some reason, there was noise in the charging system, which gave rise to additional voltage, $\delta V_l$ in $V_l$, then $\delta V_l$ is now being reflected as an error $\delta E_l$ in the error signal $E_l$ in the exposure loop. $\delta E_l$ creates actuation $\delta U_l$ to overcome the noise in the charging system. If for some reason there happens to be noise in the exposure system while the correction signal $\delta E_l$ was being executed by the exposure system, then the additional $\delta E_l$ supplied to the laser power is no longer a valid control signal. The system is now totally confused. The result will be an erroneous exposure, $V_l$. On the otherhand, if we divert the error, $\delta V_l$ to generate $\delta U_g$ with appropriate weightings, then the overall system will behave properly.

Figure 3:
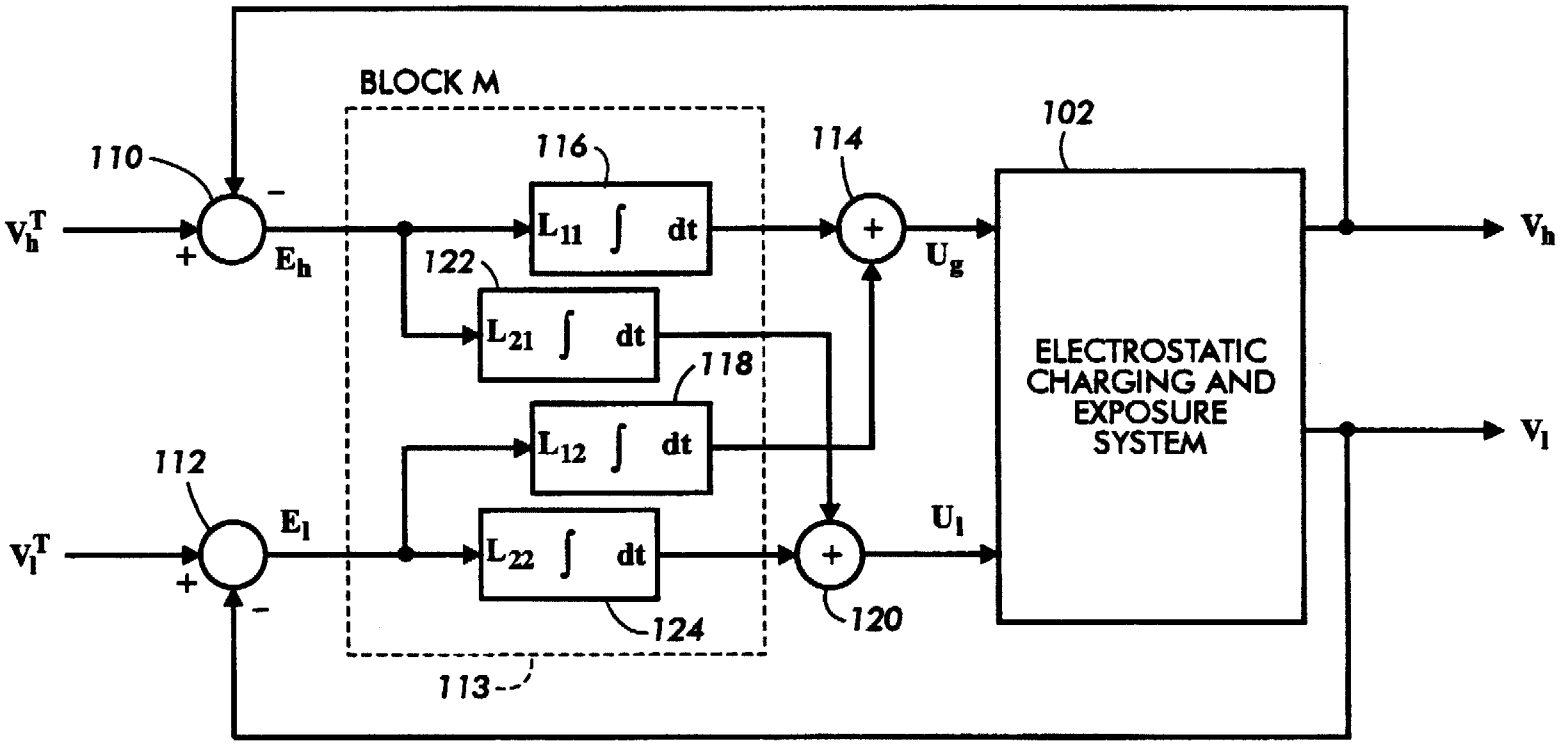
FIG. 3 illustrates a Feedback Compensator with multiple terms in a forward loop in accordance with the present invention.

A method to overcome the coupling effects is shown with a new compensator architecture in FIG. 3, in particular, forward loop compensator 113 or Block M. Here the grid voltage is generated by summing in node 114 the integration of the errors $E_h$ and $E_l$ with weightings $L_{11}$ and $L_{12}$ blocks 116 and 118 respectively. Similarly, the control signal is generated by summing in node 120 the integral of the errors $E_h$ and $E_l$ with weightings $L_{21}$ and $L_{22}$ blocks 122 and 124 respectively. Correct choice of weightings $L_{11}$, $L_{12}$, $L_{21}$, and $L_{22}$ will enable the overall system to behave properly not only in the presence of noise described above but also when there is strong coupling between inputs and outputs.

Thus, with suitable weighting or adjustment terms or elements as shown in blocks 116, 118, 122, and 124, the control system can respond to generated error signals to compensate for effects on all effected control parameters. Thus, summing node 114 integrates adjustment element or block 116 responding to error $E_h$, and adjustment element or block 118 responding to error $E_1$ to properly correct the charging system. In a similar manner, summing node 120 integrates adjustment element or block 122 responding to error $E_{h1}$ and adjustment element or block 124 responding to error $E_1$ to properly correct the exposure system. Weights can be selected in various ways by applying appropriate linear feedback control theory. This type of control system is called a multiple input multiple output/(MIMO)

Figure 4:
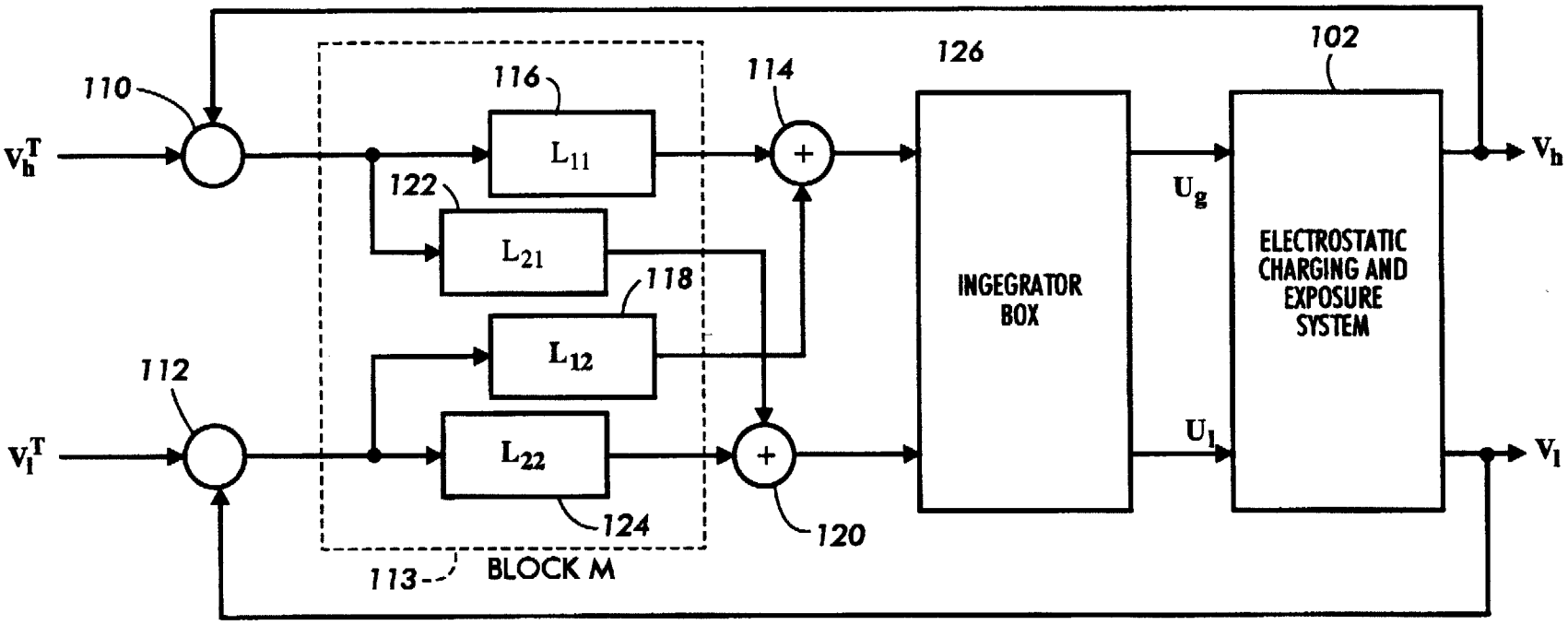
FIG. 4 illustrates a Feedback Compensator with forward loop in accordance with the present invention.

Architecture of the type shown in FIG. 3 can be extended to include the direct weighted sum of $V_h$ and $V_l$ in control quantities. This new compensator, integrator box 126 or Block N connected to nodes 114 and 120 is shown in FIG. 4. Thus integrator box 126 provides additional compensators or gain controls within the system depending upon error signals or system conditions. In this way a complex compensator is architectured with multiple gains and gives more freedom to search for an optimal operating point to force $V_h$ and $V_l$ follow the setpoints.

Figure 5:
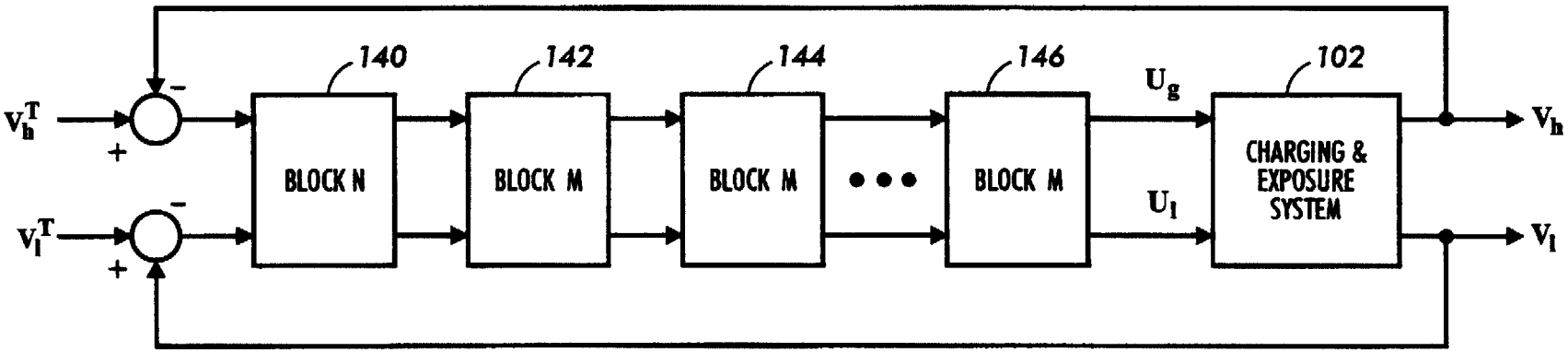
FIG. 5 illustrates a Forward Loop Compensator with multiple blocks in accordance with the present invention.

FIG. 5 shows yet another architecture, in which the forward loop compensator of the type shown in block M (in FIG. 3) loop is arranged in such a way that the output of one block becomes the input of the other block. Thus blocks 140, 142, 144, and 146 are illustrated as a sequence of elements, both forward loop compensators and integrator boxes to control the charging and exposure system 102. The weightings in each compensator blocks can be made different depending on the design.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. In an electrostatographic printing machine having an imaging member with a surface including a control system:

a sensor to measure first and second surface voltage potentials, a first control loop responsive to the first surface voltage potential measured by the sensor to provide a first adjustment to the printing machine, a second control loop responsive to the second surface voltage potential measured by the sensor to provide a second adjustment to the printing machine, wherein the improvement comprises first circuitry responsive to the first surface voltage potential to effect the second control loop and second circuitry responsive to the second surface voltage potential to effect the first control loop wherein the first circuitry and the second circuitry include look up tables.

2. The electrostatographic printing machine of claim 1 wherein the first circuitry and the second circuitry include summing nodes.

3. The electrostatographic printing machine of claim 1 wherein the first circuitry and the second circuitry include weighted compensators.

4. The electrostatographic printing machine of claim 2 including a Direct Loop Compensator interconnecting said first and second surface voltage potentials to the summing nodes.

5. A printing machine having an imaging member with a surface including a control system comprising:

first and second reference values, a sensor to measure first and second surface voltage potentials of the imaging member the first and second surface voltage potentials being compared to the first and second reference values to provide first and second error signals to control first and second process stations in the printing machine, a first compensator responsive to the first error signal to provide a first weighted adjustment to the first process station and a second weighted adjustment to the second process station, and a second compensator responsive to the second error signal to provide a first weighted adjustment to the second process station and a second weighted adjustment to the first process station in order to compensate for coupling effects between adjustments to either the first or second processing stations wherein the first and second surface voltage Potentials are unexposed and exposed voltages on the imaging member.

6. The printing machine of claim 5 wherein the first process station is a charging station and the second process station is an exposure station.

7. The printing machine of claim 5 including a first summing node connecting the compensators to the first process station and a second summing node connecting the compensators to the second process station.

8. The printing machine of claim 5 wherein the sensor is an electrostatic voltmeter.

9. A printing machine having an imaging member and a control system comprising:

a first reference value, a sensor to measure a first characteristic of the imaging member, the first characteristic being compared to the first reference value to provide a first error signal to control process stations in the printing machine, and first circuitry responsive to the first error signal to provide a first weighted adjustment to a first process station and a second weighted adjustment to a second process station wherein the first circuitry includes a summing node.

10. The printing machine of claim 9 including a second reference value, the sensor measuring a second characteristic of the imaging member, the second characteristic being compared to the second reference value to provide a second error signal, and second circuitry responsive to the second error signal to provide a first weighted adjustment to the second process station and a second weighted adjustment to the first process station.

11. The printing machine of claim 10 wherein the first and second characteristics are voltage potentials.

12. The printing machine of claim 9 wherein the first circuitry includes a weighted compensator.

13. The printing machine of claim 9 wherein the first circuitry includes a look up table.

14. The printing machine of claim 9 including a Direct Loop Compensator interconnecting the second characteristic to the summing node.

15. In a printing machine having process stations:

a sensor to measure machine characteristics, control loops responsive to machine characteristics to provide adjustments to process stations, and circuitry responsive to a control loop providing adjustments to a first process station effecting adjustments to a second process station in order to compensate for coupling effects wherein the circuitry includes a look up table.

16. The printing machine of claim 15 wherein the circuitry includes a summing node.

17. The printing machine of claim 15 wherein the circuitry includes a weighted compensator.

18. A printing machine having an imaging member and a control comprising:

a sensor to measure first and second surface voltage potentials, a first control loop responsive to the first surface voltage potential measured by the sensor to provide a first adjustment to the printing machine, a second control loop responsive to the second surface voltage potential measured by the sensor to provide a second adjustment to the printing machine, first circuitry including a summing node responsive to the first surface voltage potential to effect the second control loop, and second circuitry including a summing node responsive to the second surface voltage potential to effect the first control loop.

* * * * *